United States Patent [19]

Kramer

[11] 3,936,044

[45] Feb. 3, 1976

[54] ADJUSTABLE SHEET GUIDE

[75] Inventor: William E. Kramer, Fairport, N.Y.

[73] Assignee: Xerox Corporation, Stamford, Conn.

[22] Filed: Oct. 18, 1974

[21] Appl. No.: 515,935

[52] U.S. Cl. ..... 271/122; 24/204; 206/74; 221/242; 271/171

[51] Int. Cl.[2] ..... B65H 3/06; B65H 1/04

[58] Field of Search ..... 271/171, 170, 145, 223, 271/122; 221/242; 206/74, 73; 24/204, DIG. 18

[56] References Cited

UNITED STATES PATENTS

| | | | |
|---|---|---|---|
| 2,282,871 | 5/1942 | Malbon | 24/DIG. 18 |
| 3,588,106 | 6/1971 | Csaba et al. | 271/170 |
| 3,715,117 | 2/1973 | DiFulvio et al. | 271/171 |
| 3,861,670 | 1/1975 | Kraft | 271/122 |

*Primary Examiner*—Evon C. Blunk
*Assistant Examiner*—Bruce H. Stoner, Jr.
*Attorney, Agent, or Firm*—H. Fleischer; C. A. Green; J. J. Ralabate

[57] ABSTRACT

Adjustable guides for a sheet stack are frictionally secured to the stack support by bristle pads provided on each adjustable guide and on the stack support. Each pad has bristles inclined at an acute angle relative to the surface of the pad. Interleafing of the bristles on the guides and the stack support provides adjustable, frictional securement of the guides to the stack support.

9 Claims, 4 Drawing Figures

ADJUSTABLE SHEET GUIDE

BACKGROUND OF THE INVENTION

This invention relates generally to a sheet feeding apparatus employed in an electrophotographic printing machine, and more particularly concerns an apparatus for aligning a stack of sheets disposed within the sheet feeding apparatus.

Generally, an electrophotographic printing machine is provided with a suitable sheet tray for supporting a stack of sheets arranged to be advanced in seriatim therefrom. The sheet tray may include a friction pad or side guide adapted to engage the side edge portions of a stack of sheets disposed therein. In this way, the guide engages and aligns the side edge of the stack. By way of example, U.S. Pat. No. 3,408,064 issued to Johnson et al. in 1968, U.S. Pat. No. 1,964,498 issued to Brasseru in 1934, and U.S. Pat. No. 3,104,872 issued to Benson et al. in 1973 all discuss various types of devices arranged to engage the side edge portion of a stack of sheets for the alignment thereof.

However, a problem often encountered with such alignment devices is that the size of the sheets of support material varies. To this end, the guides are adapted to be moved to differing discrete positions corresponding to the nominal sizes of the sheets of support material employed in the electrophotographic printing machine. If non-standard size sheets of support material are employed, the guides will not generally contact the edge of the stack and the sheets therein may be misaligned.

Accordingly, it is a primary object of the present invention to improve the alignment device employed in sheet feeding apparatus by providing infinite adjustment therefore.

SUMMARY OF THE INVENTION

Briefly stated and in accordance with the present invention there is provided an apparatus for aligning a stack of sheets.

Pursuant to the features of the present invention, the apparatus includes means for supporting the stack of sheets. Guide means, mounted movably on the supporting means, contact an opposed edge of the stack of sheets. This aligns the stack of sheets positioned on the supporting means. Frictional securing means maintain the guide means on the supporting means with the vertical surface thereof contacting the stack edge opposed therefrom.

BRIEF DESCRIPTION OF THE DRAWINGS

Other objects and advantages of the present invention will become apparent upon reading the following detailed description and upon reference to the drawings, in which.

While the present invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
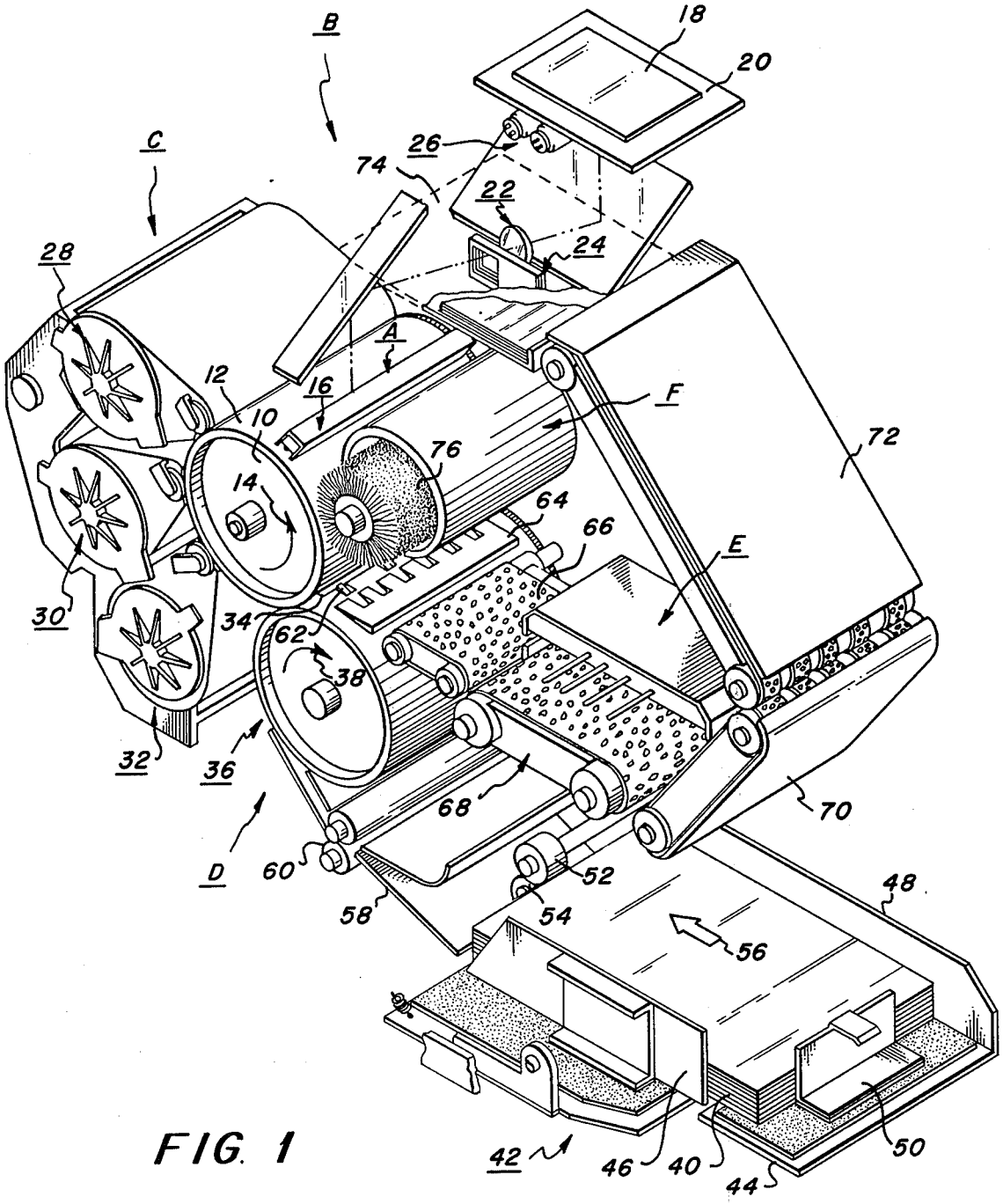
FIG. 1 is a schematic perspective view depicting a color electrophotographic printing machine incorporating the features of the present invention therein.

For a general understanding of an electrophotographic printing machine, in which the features of the present invention may be incorporated, reference is had to FIG. 1. FIG. 1 schematically illustrates the various components of an electrophotographic printing machine adapted to produce color copies from a colored original document. Continued reference will hereinafter be made to the drawings wherein like reference numerals have been used throughout to designate like elements. Although the sheet feeding apparatus of the present invention is particularly well adapted for use in an electrophotographic printing machine, it should become evident from the following discussion that it is equally well suited for use in a wide variety of machines and is not necessarily limited in its application to the particular embodiment shown herein.

The printing machine depicted in FIG. 1 employs a photoconductive member with a drum 10 having a photoconductive surface 12 entrained about and secured to the circumferential surface thereof. Drum 10 is mounted rotatably within the printing machine frame to rotate in the direction of arrow 14. A plurality of processing stations are disposed about the periphery of drum 10 and are sequentially actuated.

At charging station A, a corona generating device indicated generally at 16, charges photoconductive surface 12 to a relatively high substantially uniform potential.

Thereafter, charged photoconductive surface 12 is rotated to exposure station B. At exposure station B, a color filtered light image of original document 18 irradiates charged photoconductive surface 12. Original document 18 is supported stationarily face down upon transparent viewing platen 20. A moving lens system, generally designated by the reference numeral 22, and a color filter mechanism, shown generally at 24, are employed to form single color light images. Successive incremental areas of original document 18 are scanned by lamp assembly 26 and lens system 22 moving in timed relationship with drum 10. This scanning process produces a flowing light image which irradiates photoconductive surface 12. During exposure, filter mechanism 24 interposes selected color filters into the optical light path of lens 22. Each filter operates on the light rays passing through lens 22 to record an electrostatic latent image on photoconductive surface 12 corresponding to a pre-selected spectral region of the electromagnetic wave sprectrum, hereinafter referred to as a single color electrostatic latent image.

After the single color electrostatic latent image is recorded on photoconductive surface 12, drum 10 rotates to development station C. At development station C, three individual developer units, generally designated by the reference numerals 28, 30 and 32, respectively, render the single color electrostatic latent image visible. Each of the developer units employ a magnetic brush system having magnetizable developer mix of carrier granules and toner particles therein. The developer mix is continually brought through a directional flux field forming a brush thereof. Development is achieved by bringing the electrostatic latent image recorded on photoconductive surface 12 into contact with the developer mix brush. Each of the respective developer units, i.e. 28, 30 and 32, contain discretely colored toner particles corresponding to the complement of the spectral region of the wave length of light transmitted through filter 24. For example, a green filtered electrostatic latent image is rendered visible by depositing green absorbing magenta toner particles thereon. Similarly, blue and red electrostatic latent images are developed with yellow and cyan toner particles, respectively.

After the electrostatic latent image is developed with the appropriately colored toner particles, drum 10 rotates the developed powder image to transfer station D. At transfer station D, the single color toner powder image adhering electrostatically to photoconductive surface 12 is transferred to a sheet of support material 34. A suitable sheet of support material may be plain paper or a thermoplastic sheet, amongst others. A transfer roll, shown generally at 36, recirculates support material 34 and is electrically biased to a potential of sufficient magnitude and polarity to electrostatically attract toner particles from photoconductive surface 12 to sheet 34. Transfer roll 36 rotates in synchronism with drum 10, in the direction of arrow 38. Sheet 34 is secured releasably on transfer roll 36. After successive single color powder images have been transferred to sheet 34, in registration with one another, support material 34 is separated therefrom.

Prior to proceeding with a description of the remaining process stations, the sheet feeding path will be briefly described.

Sheet 34 is advanced from stack 40 housed in the sheet feeding apparatus, indicated generally by the reference numeral 42, of the present invention. Sheet feeding apparatus 42 will hereinafter be discussed in greater detail with reference to FIGS. 2 through 4, inclusive. In general, sheet feeding apparatus 42 includes a support or tray 44 having a generally planar surface for supporting stack 40 thereon. Guides are provided for aligning the side and rear edges of the stack of sheet material. The guides include a side wall 46 having a generally planar vertical surface engaging one side edge of stack 40. Side wall 46 is movable relative to the tray 44. The other side edge of stack 40 engages stationary side wall 48. Movable rear wall 50 engages the rear edge of the stack aligning and positioning it in contact with feed roll 52 and retard roll 54. Feed roll 52 cooperates with retard roll 54 to separate and advance successive uppermost sheets from stack 40. The advancing sheet moves in the direction of arrow 56 into chute 58 and is directed into the nip of register rolls 60. Register rolls 60 align and forward sheet 34 to transfer roll 36 where gripper fingers 62 secure it thereto.

After a plurality of toner powder images have been transferred to support material 34, gripper fingers 62 spaces support material 34 from transfer roll 36 enabling stripper bar 64 to be interposed therebetween. Support material 34 is then transported on endless belt conveyor 66 to fixing station E. At fixing station E, a fuser, generally indicated by the reference numeral 68, heats the transferred toner powder images to permanently affix it to support material 34. After the toner powder image is permanently affixed to support material 34, support material 34 is advanced by endless belt connveyors 70 and 72 to catch tray 74 for subsequent removal therefrom by the machine operator.

Although a preponderance of the toner particles are transferred to support material 34, invariably some residual toner particles remain on photoconductive surface 12 after the transfer thereof. These residual toner particles are removed from drum 10 as it passes through cleaning station F. Initially, the toner particles are brought under the influence of a corona generating device adapted to neutralize the electrostatic charge remaining on photoconductive surface 12 and the residual toner particles. The neutralized toner particles are removed from photoconductive surface 12 by a rotatably mounted fibrous brush 76 in contact therewith.

It is believed that the foregoing description is sufficient for purposes of the present application to illustrate the general operation of an electrophotographic printing machine embodying the teachings of the present invention therein.

Figure 2:
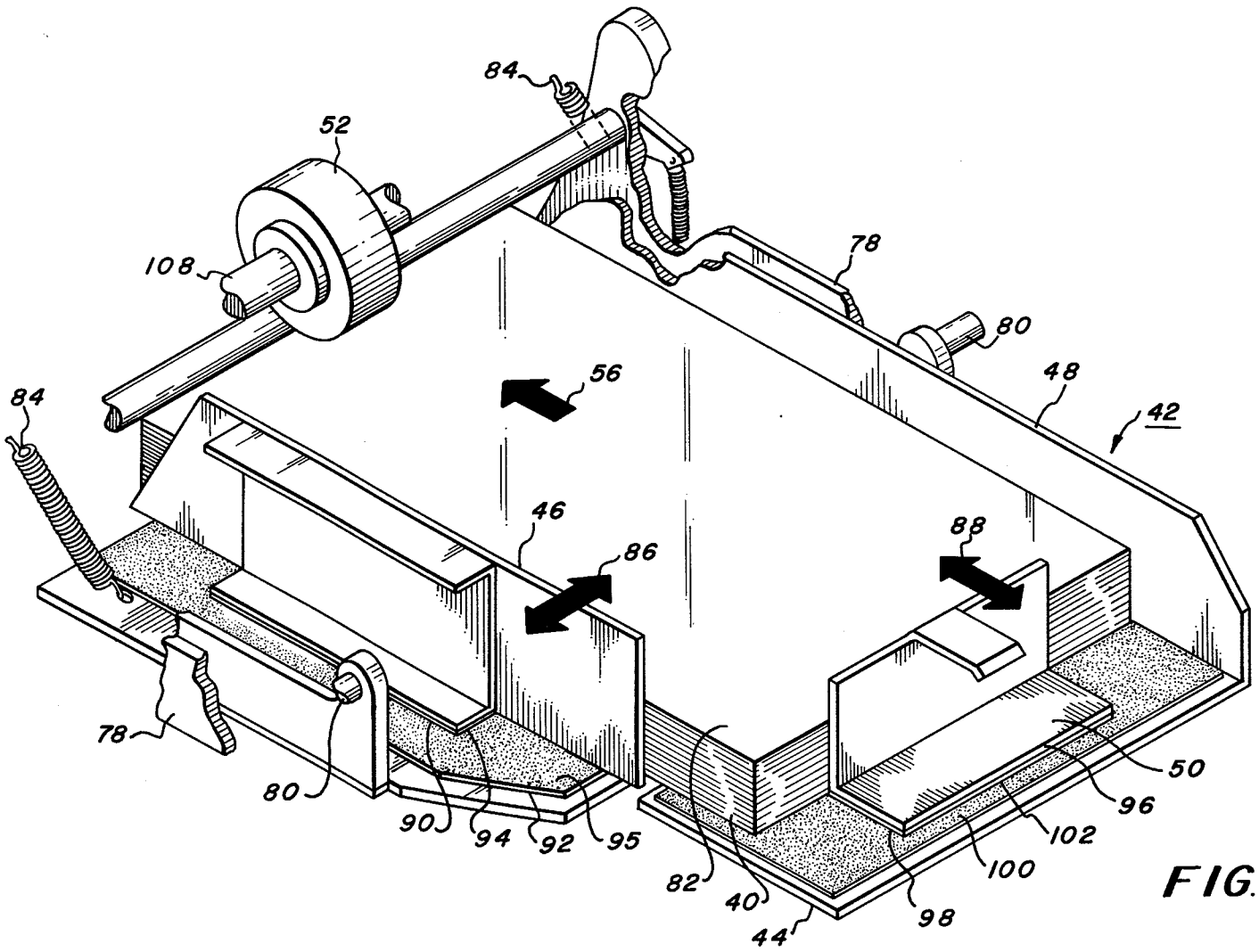
FIG. 2 is a schematic perspective view showing the sheet feeding apparatus of the FIG. 1 printing machine.

Turning now to FIG. 2, sheet feeding apparatus 42 will be described with reference thereto in greater detail. Sheet feeding apparatus 42 includes a frame 78 mounted movably in the printing machine. Tray 44 is mounted pivotably on frame 78 and pivots in a clockwise direction about shaft 80. In this manner, the leading marginal edge portion of uppermost sheet 82 engages feed roller 52. A pair of springs 84 suitably attached to frame 78 resiliently urge tray 44 to pivot in a clockwise direction. Tray 44 has a generally planar surface for supporting stack 40 thereon. Stack 40 is positioned both longitudinally and laterally on tray 44 by means of side walls 46 and 48 and rear wall 50. Side wall 48 is mounted stationarily on tray 44. Side wall 46 is mounted slidably on tray 44 moving in the direction of arrow 86 so as to be adjustable for various stack widths. Rear wall 50 is mounted slidably on tray 44. In this manner, rear wall 50 is adapted to slide, in the direction of arrow 88, relative to tray 44 so as to be adjustable for varying size stack lengths. Side walls 46 and 48 have a generally vertical planar surface for aligning the side edge portions of stack of support material disposed on tray 44. Similarly, rear wall 50 includes a generally vertical planar surface for aligning the rear or trailing edge portion of the stack of sheet material disposed on tray 44. In addition, rear wall 50 prevents the stack from sliding away from the feed roll when the sheets therein are substantially depleted, i.e. at low stack heights. A friction pad 90 is secured to the underside of side wall 46. Friction pad 90 mates with a corresponding friction pad 92 secured to tray 44. Friction pads 90 and 92 include a plurality of bristles 94 and 95 extending outwardly therefrom and arranged to be interleaved with one another. In this way, the interleaved bristles produce a frictional force of sufficient magnitude to maintain side wall 46 in any selected position, i.e. in contact with the side edge of stack 40. Pad 92 mounted on tray 44 has to be of sufficient length to provide the range necessary to move side wall 46. By way of example, pad 92 may extend about 4 inches in a direction substantially parallel to arrow 86. Thus, side wall 46 may be adjustable to account for varying width stacks of from 5 to 9 inches. Similarly, pad 96 having bristles 98 extending outwardly therefrom is mounted on rear wall 50. Bristles 98 of pad 96 interleaf with bristles 100 extending outwardly from pad 102 mounted on tray 44. Once again, pad 102 must be of sufficient length to permit rear wall 50 to be adjusted for varying length stacks. Thus, if pad 102 is 8 inches long rear wall 50 may be adjusted for stacks varying in length from 6 to 14 inches. The foregoing arrangement provides for a wide range of adjustment which can be readily extended by selecting suitable length pads.

Figure 3:
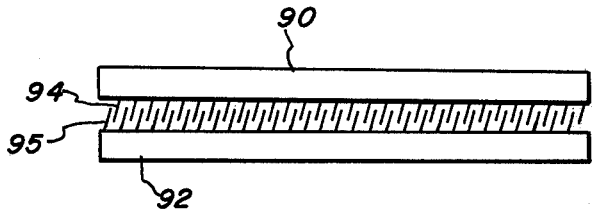
FIG. 3 is an elevational view illustrating the frictional mechanism for securing the guide in contact with the edge of the stack of sheets on the tray of the FIG. 2 sheet feeding apparatus.

Turning now to FIG. 3, the orientation of the bristles for each of the mating pads will be disucssed in greater detail. The orientation of bristles 94 and 95 of pads 90 and 92, respectively, is substantially the same as the orientation of bristles 98 and 100 of pads 96 and 102, respectively. Accordingly, only the relationship of bristles 94 and 95 of pads 90 and 92 will be discussed. As shown in FIG. 3, bristles 94 extend in an upwardly direction from and at an acute angle relative to the surface of pad 90. Similarly, bristles 95 extend in an upwardly direction from pad 92 at an acute angle to the surface thereof. Bristles 94 extend in a direction substantially parallel to the direction of bristles 95. Thus, the bristles interleaf with one another so as to frictionally retard the movement of the side wall or rear wall relative to the tray member. By way of example, one material from which friction pads 90, 92, 96 and 102 may be made is sold under the tradename Fibre-tran, and is manufactured by the Minnesota Mining and Manufacturing Co. However, any material having a high coefficient of friction with a plurality of bristles extending therefrom is suitable. For example, most materials utilized for automobile brake linings may be employed for friction pads. Bristles 94 and 95 extending from pads 90 and 92, respectively, are adapted to be interleafed with one another so as to substantially increase the frictional force retarding the movement of side wall 46 relative to tray 44. In this way, the bristles produce a frictional force of sufficient magnitude to retard the relative movement therebetween and to insure that side wall 46 is maintained in contact with the side edge of stack 40, and rear wall 50 contacts the rear edge of stack 40.

Figure 4:
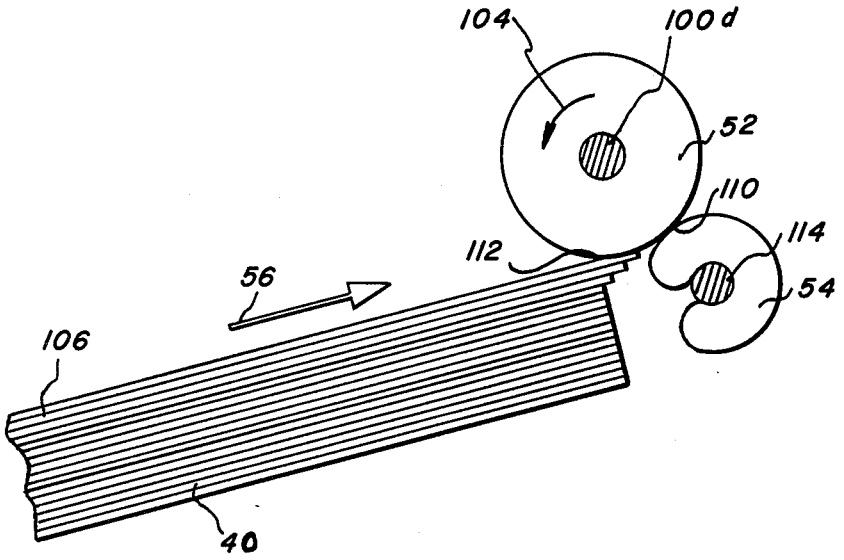
FIG. 4 is an enlarged elevational view depicting the relationship between the feed roller, retard roller and stack of sheets in the FIG. 2 sheet feeding apparatus.

Referring now to FIG. 4, feed roller 52 is driven by a suitable motor (not shown) in the direction of arrow 104 to advance uppermost sheet 106 in the direction of arrow 56. Shaft 108 secures feed roller 52 fixedly to frame 78. Feed roller 52 is, preferably, arranged to rotate in the direction of arrow 104, and engages the uppermost sheet of stack 40. Feed roller 52 has a first portion 110 of the circumferential surface thereof engaging retard roller 54, and a second portion 112 of the circumferential surface engaging sheet 106. As illustrated in FIG. 4, feed roller 52 has first portion 110 engaging retard roller 54 substantially simultaneously with second portion 112 engaging sheet 106. Retard roller 54 is mounted eccentrically of shaft 114. Shaft 114 is mounted rotatably on frame 78 and is adapted to pivot retard roller 54 from a position spaced from feed roller 52 to a position in engagement therewith. The cooperation between feed roller 52 and retard roller 54 is more fully discussed in co-pending application Ser. No. 304,032 filed in 1972, now U.S. Pat. No. 3,861,670 the relevant portions of that disclosure being hereby incorporated into the present application.

From the foregoing it is apparent that the sheet feeding apparatus of the present invention has infinitely adjustable side and rear walls enabling differing size stacks of sheet material to be disposed therein. The foregoing is achieved by the utilization of pads having bristles extending outwardly therefrom. The bristles of the pads interleaf with one another to frictionally secure the side walls and rear walls in any desired position. In this way, any size stack of sheet material may be mounted within the sheet feeding apparatus.

Thus, it is apparent that there has been provided, in accordance with the present invention, a sheet feeding apparatus that fully satisfies the objects, aims and advantages set forth above. While this invention has been described in conjunction with a specific embodiment thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

What is claimed is:

1. An apparatus for aligning a stack of sheets, including:

means for supporting the stack of sheets;

guide means mounted movably on said supporting means and having at least one generally planar, substantially vertical surface opposed from the edge of the stack of sheets;

a first pad secured to said supporting means, said first pad having a plurality of bristles extending in an outwardly direction defining an acute angle relative to the surface thereof; and a second pad secured to said guide means, said second pad having a plurality of bristles extending in an outwardly direction defining an acute angle relative to the surface thereof in a direction substantially parallel to the bristles of said first pad so that the bristles of said first pad interleaf with the bristles of said second pad retarding frictionally the relative movement between said guide means and said supporting means.

2. An apparatus as recited in claim 1, wherein said supporting means includes a tray member having a generally planar surface for supporting thereon a stack of sheets, said first pad being mounted on said tray member.

3. An apparatus as recited in claim 2, wherein said guide means includes:

a first movable side wall having a generally planar surface adapted to engage an opposed side edge of the stack of sheets, said second pad being mounted on said first side wall with the bristles thereof interleafing with the bristles of said second pad mounted on said tray member; and a second stationary side wall having a generally planar surface, said second side wall being opposed and spaced from said first side wall, said second side wall planar surface being adapted to engage the side edge of the stack opposed therefrom.

4. An apparatus as recited in claim 3, further including:

a movable rear wall having a generally planar surface adapted to engage a rear edge of the stack opposed therefrom;

a third pad secured to said rear wall, said third pad having a plurality of bristles extending in an outwardly direction therefrom defining an acute angle relative to the surface of said third pad; and a fourth pad secured to said tray member, said fourth pad having a plurality of bristles extending in an outwardly direction therefrom defining an acute angle relative to the surface of said fourth pad and extending in a parallel direction to the bristles of said third pad so that the bristles of said third pad interleaf with the bristles of said fourth pad retarding frictionally the relative movement between said rear wall and said tray member.

5. A sheet feeding apparatus, including:

means for supporting a stack of sheets;

means for separating and advancing successive sheets from the stack disposed on said supporting means;

guide means mounted movably on said supporting means and having at least one generally planar, substantially vertical surface opposed from an edge of the stack of sheets;

a first pad secured to said supporting means, said first pad having a plurality of bristles extending in an outwardly direction defining an acute angle relative to the surface thereof; and a second pad secured to said guide means, said second pad having a plurality of bristles extending in an outwardly direction defining an acute angle relative to the surface thereof in a direction substantially parallel to the bristles of said first pad so that the bristles of said first pad interleaf with the bristles of said second pad retarding frictionally the relative movement between said guide means and said supporting means.

6. A sheet feeding apparatus as recited in claim 5, wherein said supporting means includes a tray member having a generally planar surface for supporting thereon a stack of sheets, said first pad being mounted on said tray member.

7. A sheet feeding apparatus as recited in claim 6, wherein said guide means includes:

a first movable side wall having a generally planar surface adapted to engage an opposed side edge of the stack of sheets, said second pad being mounted on said first side wall with the bristles thereof interleafing with the bristles of said second pad mounted on said tray member; and a second stationary side wall having a generally planar surface, said second side wall being opposed to and spaced from said first side wall, said second wall planar surface being adapted to engage the side edge of the stack opposed therefrom.

8. A sheet feeding apparatus as recited in claim 7, further including:

a movable rear wall having a generally planar surface adapted to engage a rear edge of the stack opposed therefrom;

a third pad secured to said rear wall, said third pad having a plurality of bristles extending in an outwardly direction therefrom defining an acute angle relative to the surface of said third pad; and a fourth pad secured to said tray member, said fourth pad having a plurality of bristles extending in an outwardly direction therefrom defining an acute angle relative to the surface of said fourth pad and extending in a direction parallel to the bristles of said third pad so that the bristles of said third pad interleaf with the bristles of said fourth pad retarding frictionally the relative movement between said rear wall and said tray member.

9. A sheet feeding apparatus as recited in claim 5, wherein said separating and advancing means includes:

a retard roller mounted on said supporting means;

biasing means for resiliently urging said retard roller to pivot from an inoperative position spaced from one surface of the advancing sheet to an operative position in contact therewith; and a rotary driven feed roller having a first portion of the circumferential surface thereof engaging the other surface of the sheet and a second portion of the circumferential surface engaging the circumference of said retard roller disposed in the operative position thereof prior to the advancing sheet being interposed therebetween, said feed roller advancing the sheet into the nip defined by said feed roller and said retard roller to prevent multiple sheet feeding.

* * * * *